US007051882B2

(12) United States Patent
Ödmark et al.

(10) Patent No.: US 7,051,882 B2
(45) Date of Patent: May 30, 2006

(54) TWIN-WIRE BELT PRESS

(75) Inventors: Leif Ödmark, Matfors (SE); Göran Olsson, Njurunda (SE); Mats Ullmar, Sundsvall (SE)

(73) Assignee: Metso Paper, Inc. (FI)

( * ) Notice: Subject to any disclaimer, the term of this patent is extended or adjusted under 35 U.S.C. 154(b) by 79 days.

(21) Appl. No.: 10/343,501

(22) PCT Filed: Jul. 26, 2001

(86) PCT No.: PCT/SE01/01677

§ 371 (c)(1),
(2), (4) Date: Jul. 30, 2003

(87) PCT Pub. No.: WO02/10509

PCT Pub. Date: Feb. 7, 2002

(65) Prior Publication Data

US 2004/0011727 A1 Jan. 22, 2004

(30) Foreign Application Priority Data

Aug. 1, 2000 (SE) ..... 0002807

(51) Int. Cl.

| | |
|---|---|
| ***B30B 9/24*** | (2006.01) |
| ***B01D 33/052*** | (2006.01) |
| ***D21F 1/80*** | (2006.01) |
| ***D21F 3/04*** | (2006.01) |

(52) U.S. Cl. ..... 210/401; 210/386; 100/118; 100/121; 162/300; 162/301; 162/360.2

(58) Field of Classification Search ..... 210/401, 210/386; 100/118, 121; 162/300, 301, 360.2
See application file for complete search history.

(56) References Cited

U.S. PATENT DOCUMENTS

| | | | | |
|---|---|---|---|---|
| 3,315,370 | A * | 4/1967 | Hikosaka | 34/70 |
| 3,951,809 | A * | 4/1976 | Kollmar | 210/241 |
| 4,142,461 | A * | 3/1979 | Bastgen | 100/118 |
| 4,159,947 | A * | 7/1979 | Brooks et al. | 210/108 |
| 4,181,616 | A * | 1/1980 | Bahr | 210/297 |
| 4,303,523 | A * | 12/1981 | Ruppnig | 210/386 |
| 4,475,453 | A * | 10/1984 | Davis | 100/118 |
| 4,584,936 | A * | 4/1986 | Crandall et al. | 100/118 |
| 4,681,033 | A | 7/1987 | Crandall et al. | |
| 5,545,333 | A * | 8/1996 | Louden et al. | 210/739 |
| 6,003,684 | A * | 12/1999 | Eickhoff et al. | 210/401 |
| 6,248,245 | B1 * | 6/2001 | Thompson | 210/783 |
| 6,338,773 | B1 * | 1/2002 | Sbaschnigg et al. | 162/300 |
| 6,543,623 | B1 * | 4/2003 | Sebright et al. | 210/400 |

FOREIGN PATENT DOCUMENTS

WO 99/01609 A1 1/1999

* cited by examiner

*Primary Examiner*—Thomas M. Lithgow
(74) *Attorney, Agent, or Firm*—Lerner, David, Littenberg, Krumholz & Mentlik, LLP

(57) ABSTRACT

A twin-wire belt press is disclosed for dewatering a fiber suspension and forming a continuous web of the fiber suspension. The twin wire belt includes a plurality of upper and lower rolls, a perforated roll and endless upper and lower wire belts. Dewatering tables are used to support the endless upper and lower wire belts and form a wedge-shaped pressure space between the endless upper and lower wire belts for initially pressing and dewatering the fiber suspension and forming a web therebetween. Roll members, including at least two press rolls which form press roll nips with the perforated roll and another roll, press and dewater the web between the endless upper and lower wire belts.

5 Claims, 1 Drawing Sheet

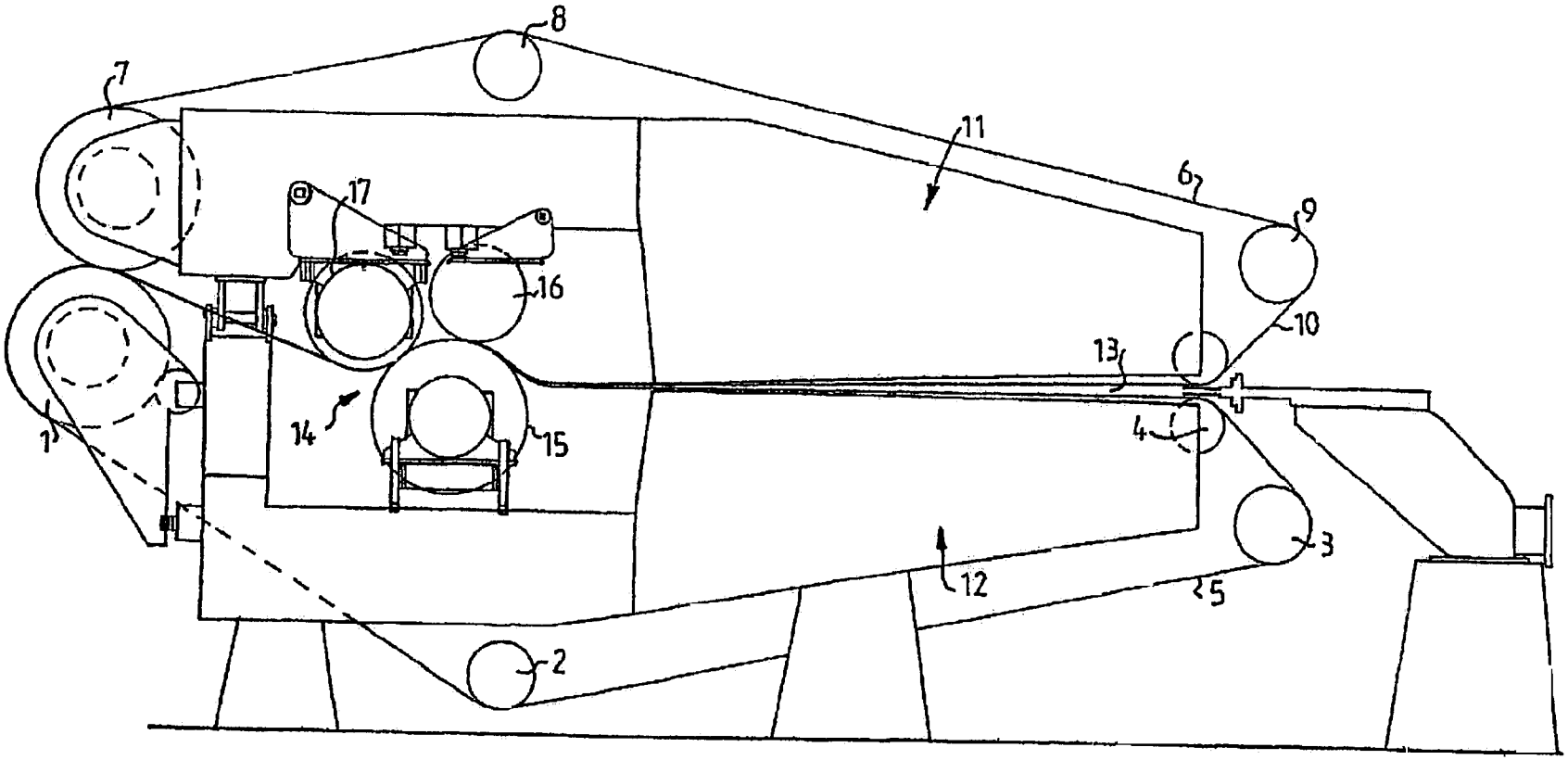
1
2
3
4
5
6
7
8
9
10
11
12
13
14
15
16
17

TWIN-WIRE BELT PRESS

The present invention relates to a twin-wire belt press for dewatering of a fiber suspension and forming of a continuous web thereof, comprising lower rolls, an endless lower wire belt running in a path around the lower rolls, upper rolls, and an endless upper wire belt running in a path around the upper rolls. The two wire belts co-operate with each other along sections of the paths that run substantially in parallel with each other for dewatering of the fiber suspension between the wire belts during displacement thereof. The twin-wire belt press further comprises two dewatering tables supporting the respective wire belts in the sections of the path and forming a wedge-shaped pressure space between the wire belts for initially pressing and dewatering the fiber suspension, whereby a web is formed between the wire belts, and a roll arrangement situated after the dewatering tables in the sections of the paths, as seen in the direction of movement of the wire-belts, for finally pressing and dewatering the web between the wire belts, so that the web will get a desired dryness.

BACKGROUND OF THE INVENTION

Traditionally, the roll arrangement in known twin-wire belt presses of this kind comprises a number of wire belt guide rolls and a number of pairs of press rolls. The wire-belt guide rolls are arranged directly after the dewatering tables to provide an initial, relatively weak dewatering of the fiber suspension between the wire belts by forcing these to curve around the wire belt guide rolls, so that the wire belts are pressed under surface bearing on the wire belt rolls. (The arrangement of such wire belt guide rolls usually is called an "S-roll portion".) The press rolls are arranged after the wire belt guide rolls to provide a final, relatively strong dewatering of the fiber suspension in that each roll pair forms a press roll nip, so that the wire belts are pressed together between the press rolls under substantially line bearing on these. Normally at least two wire belt rolls and a plurality of press rolls are needed to gradually dewater the web between the wire belts, so that there is no risk of getting a breakdown of the web.

WO 99/01609 proposes a twin-wire belt press in which a combined roll pair arranged next to the dewatering tables forms a press roll nip and forces the wire belts to curve around the rolls as well. Two rolls in the press roll arrangement can therefore be eliminated, which provides a cheaper and shorter press. A drawback of the known twin-wire belt press according to WO 99/01609, however, is that the press roll nip directly after the dewatering tables generates a relatively large flow of white water that cannot completely be removed from the web. This results in a portion of the white water flow rewetting the web.

SUMMARY OF THE INVENTION

The object of the present invention is to provide a simpler, smaller, cheaper and more reliable twin-wire belt press than traditional belt presses.

This object is obtained by a twin-wire belt press of the kind described wherein the roll arrangement comprises at least one perforated hole roll that presses against the wire belts, whereby water that is pressed by the hole roll out of the web between the wire belts is at least partly drained through the hole roll. This effectively prevents rewetting of the web with white-water, which results in a reduction of the number of rolls in the twin-wire belt press. The expression "hole roll" is intended to mean a pressure roll with perforations in its mantle. For example, the perforations can communicate with outlet channels in the press roll. White water from the web is thus evacuated through the perforations and away from the wire belts.

Preferably, the roll arrangement comprises at least one press roll forming a press roll nip with the hole roll. The press roll nip is situated directly after the dewatering tables, as seen in the direction of movement of the wire belts. The hole roll is suitably situated under the wire belts in the section of the paths, which gives a favourable white-water drain from the outlet channels of the hole roll.

According to a preferred embodiment of the invention the roll arrangement comprises two press rolls, a first press roll and a second press roll situated after the first press roll, as seen in the direction of movement of the wire belts. These press rolls press the two wire belts in the sections of the paths against the hole roll, so that the wire belts, in part, enclose the hole roll. Normally, there is no need for additional rolls for most applications, which makes this embodiment of the twin-wire belt press according to the invention particularly advantageous. Thus, the need for maintenance is reduced due to the fact that few roll bearings and hydraulic components are needed. In addition, the twin-wire belt press according to the invention will be substantially smaller than a conventional press of the same capacity. A further advantage is that the lifetime of the wire belts will be longer than wire belts used in prior art twin-belt presses, since the number of load cycles on the wire belts will be fewer with fewer rolls.

The first press roll may have the same diameter as the second press roll, or may have a shorter or a larger diameter than the second press roll. Furthermore, the first press roll may be situated directly after the dewatering tables in the sections of the paths of the wire belts. Suitably, the second press roll is arranged to press harder against the whole roll than the first press roll. To increase the contact surface between the wire belts and the press rolls, the press rolls may advantageously be faced with an elastic material, for instance rubber. Also the press rolls may be designed with perforations like the whole roll. Alternatively, the press rolls may be provided with patterns forming dewatering channels.

The invention is described in more detail in the following with reference to the accompanying drawing, which shows a view of a longitudinal cross-section through a twin-wire belt press according to the invention.

BRIEF DESCRIPTION OF THE DRAWINGS

FIG. 1 is a front plan view of the twin-wire belt press in accordance with the present invention.

DETAILED DESCRIPTION

FIG. 1 shows a twin-wire belt press in accordance with the present invention comprising four lower rolls: a drive roll 1, a control roll 2, a tensioning roll 3 and a wire belt guide roll 4. An endless lower wire belt 5 runs in a path around the lower rolls 1–4. In a corresponding manner, an upper endless wire belt 6 runs in a path around four upper rolls: a drive roll 7, a control roll 8, a tensioning roll 9 and a wire belt guide roll 10. Between the rolls 1 and 7, and between the rolls 4 and 10 there are sections of the paths running substantially in parallel with each other, wherein the lower wire belt 5 and the upper wire belt 6 co-operate with each other for dewatering a fiber suspension between the wire belts 5,6 during displacement of the wire belts 5,6. An upper dewatering table 11 supporting the upper wire belt 6 and a lower dewatering table 12 supporting the lower wire belt 5 form a wedge-shaped pressure space 13 between the wire belts in the sections of the paths.

A roll arrangement 14 is situated after the dewatering tables 11,12 in the sections of the paths, as seen in the direction of movement of the wire belts 5,6. The roll arrangement comprises three rolls: a perforated hole roll 15, which bears on the underside of the lower wire belt 5 in the section, a first press roll 16, which bears relatively lightly on the upper side of the upper wire belt 6 in the section between the dewatering tables 11,12 and the hole roll 15 and which forms a press roll nip together with the hole roll 15, and a second press roll 17, which bears relatively heavily on the upper side of the upper wire belt 6 in the section and which likewise forms a press roll nip together with the hole roll 15. In the embodiment of twin-wire belt press shown the first press roll 16 has a shorter diameter than the second press roll 17, which is preferred. However, the first press roll 16 may also be designed with a diameter that is equal to or larger than that of the second press roll 17.

In the operation of the twin-wire belt press according to FIG. 1, the drive rolls 1 and 7 are rotated by motors not shown, so that the wire belts 5,6 travel at the same speed through the dewatering tables 11,12 and further through the roll arrangement 14. The fiber suspension to be dewatered is supplied to the wedge-shaped space 13 between the dewatering tables 11,12 and is conveyed by the wire belts 5,6 through the space 13 while being compacted between the wire belts 5,6, so that white-water escapes from the fiber suspension which thereby is formed into a web. The web leaving the dewatering tables 11,12 passes during a first dewatering step the press roll nip between the lightly loaded smaller first press roll 16 and hole roll 15, bears surface to surface during a subsequent second dewatering step on the hole roll 15 during a part of the rotation thereof and passes during a subsequent third dewatering step the press roll nip between the heavily loaded larger second press roll 16 and the hole roll 15. The white-water pressed out of the web during the three dewatering steps escapes gradually from the web and the greater portion of the white-water evacuates through the hole roll 15 without rewetting the web. The continuous web with a desired dryness is fed out from the press between the drive rolls 1 and 7.

Of course, the invention is not limited to the embodiment shown but may be varied within the scope of the attached claims. Thus, more rolls than shown may be arranged for dewatering the web, for example in the form of a roll arrangement forming a so called S-roll portion, or by applying more press rolls than the press rolls 16 and 17 on the hole roll 15. Alternatively, only one press roll may bear on the hole roll 15. At least any of the press rolls shown may be faced with rubber with a smooth or patterned surface. Alternatively, at least any of the press rolls 16,17 may be designed with perforations like the hole roll 15.

The hole roll 15 may be arranged in a different position in the twin-wire belt press than shown. The wire belts 5 and 6 may also be guided by wire belt guide rolls around a portion of the circumference of the hole roll 15 under surface to surface bearing without arranging a press roll nip. Additional hole rolls of the same kind as the hole roll 15 as shown may also be arranged in the twin-wire belt press.

As these and other variations and combinations of the features discussed above can be utilized without departing from the invention as defined by the claims, the foregoing description of the preferred embodiments should be taken by way of illustration rather than by way of limitation of the invention as defined by the claims.

The invention claimed is:

1. A twin wire belt press for dewatering a fiber suspension and forming a continuous web of said fiber suspension comprising a plurality of lower rolls, an endless lower wire belt running in a first path around said plurality of lower rolls, a plurality of upper rolls, an endless upper wire belt running in a second path around said plurality of upper rolls, said endless lower wire belt and said endless upper wire belt juxtaposed with each other along sections of said first and second paths running substantially parallel to each other in a predetermined direction within a predetermined area having a first end to a second end for dewatering said fiber suspension therebetween, first and second dewatering tables supporting said endless lower wire belt and said endless upper wire belt, respectively, at said first end of said predetermined area forming a wedge shaped pressure space between said endless lower wire belt and said endless upper wire belt for initially pressing and dewatering said fiber suspension and forming a web therebetween, and roll members at said second end of said predetermined area for finally pressing and dewatering said web between said endless lower wire belt and said endless upper wire belt, said roll members including at least one perforated roll pressing against a first side of said endless lower wire belt and said endless upper wire belt and first and second press rolls for pressing against a second side of said endless lower wire belt and said endless upper wire belt against said at least one perforated roll whereby water pressed out of said web thereby is at least partially drained through said at least one perforated roll, said first and second press rolls forming press roll nips with said at least one perforated roll and said second press roll applying a greater pressing force against said perforated roll than said first press roll.

2. The twin-wire belt press according to claim 1, wherein said press roll nips are situated directly after said dewatering tables in said predetermined direction.

3. The twin-wire belt press according to claim 2, wherein at least one of said press rolls comprises an elastic material.

4. The twin wire belt of claim 1, wherein said dewatering tables comprise a flat surface over which said endless lower wire belt and said endless upper wire belt pass.

5. The twin wire belt of claim 1, wherein said dewatering tables provide even dewatering of said fiber web.

* * * * *